US006116025A

United States Patent [19]

Tucker

[11] Patent Number: 6,116,025

[45] Date of Patent: Sep. 12, 2000

[54] DYNAMIC, AUTOMATIC STROKE REVERSAL SYSTEM FOR RECIPROCATING, LINEARLY DRIVEN PUMPING UNITS

[76] Inventor: Joe W. Tucker, 11413 Oak Knoll Dr., Austin, Tex. 78759

[21] Appl. No.: 08/998,667

[22] Filed: Dec. 29, 1997

[51] Int. Cl.[7] ..... F16D 31/02

[52] U.S. Cl. ..... 60/372

[58] Field of Search ..... 60/372

[56] References Cited

U.S. PATENT DOCUMENTS

| | | | |
|---|---|---|---|
| 2,279,057 | 4/1942 | Reed | 60/372 |
| 2,605,612 | 8/1952 | Mason | 60/372 |
| 4,114,375 | 9/1978 | Saruwatari | 60/372 |
| 4,347,049 | 8/1982 | Anderson | 60/372 |
| 4,571,939 | 2/1986 | Dollison | 60/372 |

*Primary Examiner*—F. Daniel Lopez

[57] ABSTRACT

This pneumatic stroke reversal system for reciprocating, linearly driven pumping units is completely automatic in its cyclic operation, and greatly improves efficiency. A smaller drive motor is required because kinetic energy is stored at the end of each stroke, to be returned to the system to assist in beginning and accelerating the following stroke, and because the smooth and controlled reversals allow a substantially higher stroke velocity and production from a unit of a given size. The reversals are effective on both the upstroke and the downstroke, and their maximum net values are individually selectable over a wide range, and adjustable in the field. The exact points of direction change occur at the instant of maximum rod stretch and maximum rod contraction, respectively, thereby greatly reducing parasitic rod string oscillation, and reducing pressure peaks on, and problems with, the rod string. The subject system is beneficial for long stoke hydraulic pumping units, and it also makes possible very efficient and economical short stroke hydraulic pumping units because of the smaller motor and greater stroke velocity which is made possible. This reversal system is uncomplicated and flexible in its application, requires few moving parts, and can be used in any of a number of embodiments.

32 Claims, 8 Drawing Sheets

DYNAMIC, AUTOMATIC STROKE REVERSAL SYSTEM FOR RECIPROCATING, LINEARLY DRIVEN PUMPING UNITS

FIELD OF THE INVENTION

The subject invention applies to linearly driven pumping units, and utilizes compressed gas to store kinetic energy from the latter portion of each upstroke and downstroke, and returns this energy to the reversal system to assist in the beginning and acceleration of each succeeding stoke. Cyclic operation is automatic, and the maximum value of the progressive upstroke and downstroke reversal forces is individually selectable and adjustable in the field.

A pneumatic counterbalance system may be used, and the variation of its pressure and force during each stoke is compensated for by the subject reversal system. The operation of the reversal system is such that the instant of reversal occurs at the instant of greatest rod stretch and greatest rod contraction, respectively. A relatively high stroke velocity is provided along with reduced rod stress.

BACKGROUND OF THE INVENTION

The prior art contains many pumping unit designs, all of which have at least some shortcomings, and only a few of which have isolated features or operational characteristics which are similar to any of those of the subject invention.

Most obvious among these shortcomings is the absence of an efficient stroke reversal mechanism in combination with a linear drive mechanism which provides a relatively high stroke velocity, eliminates power peaks, and allows a smaller, more efficient motor for either long or short stroke units.

Within the field of the present invention, only applicants' U.S. Pat. No. 5,536,150 incorporates features which furnish a stroke reversal capability and eliminate parasitic rod string oscillation due to stroke reversal. All of the other prior designs cause the reversal of the polish rod and upper end of the rod string with little regard for the current forces upon the lower and central portions of the rod string due to inertia and rod stretch.

This often results in the upper end of the rod string reversing from upward to downward movement while the lower end of the rod string is still moving upward, and, respectively, reversing from downward movement to upward movement at its upper end while its lower end is still moving downward.

The beam unit which utilizes a flywheel type counterbalance has been by for the most popular and successful pumping unit for many years. Its rotary drive connection to the beam produces a smooth reversal, and its flywheel transfers kinetic energy from one stroke to the next. Its drive motor is engaged constantly, which is an advantage, although there are power peaks, and a large motor is required.

The beam unit does have serious drawbacks. The required gearbox is heavy and expensive, and the stroke length is limited to about twenty feet. The polish rod and top end of the rod string reverses direction without regard for existing conditions of stretch or contraction in the rod string, and parasitic rod string oscillation is often a problem. Stroke velocity is then limited and rod string problems are a factor.

The beam unit which utilizes counterweights attached to the beam has had some success in the smaller capacity units. With this unit there is a very limited transfer of energy from each upstroke and downstroke to the succeeding stroke, and as the stroke velocity increases, the efficiency of the unit decreases, which is perhaps the reason for its limited success.

Linearly driven pumping units, both mechanical and hydraulic, are very well represented in the prior art.

Applicants' U.S. Pat. No. 5,536,150 describes a hydraulic/pneumatic stroke reversal system which requires the cyclic opening and closing of at least one hydraulic valve.

This design has many of the same desirable operational characteristics that the subject invention does: energy is transferred to the following stroke, reversals are smooth and at the instant of greatest rod stretch or contraction, and a higher stroke velocity and more efficiency are provided.

There are many designs of linearly driven mechanical pumping units which use a mechanical counterweight. Very few of these designs show us a reversal system which transfers energy, and the problems of reversals are doubled because of the inertia of the counterweight mass. Almost all of these designs are for long stroke units, in which the reversal problems and power losses are minimized by a low stroke velocity and low cadence.

One such unit which has enjoyed commercial success is the RotaFlex® unit which is marketed by Energy Ventures, Inc. It uses an endless chain drive, and the reversal characteristics are determined by the size of the drive sprocket. At least some energy is transferred from one stroke to the next, but the reversals do not make allowance for rod stretch or contraction. This unit is referred to as a long, slow stroke unit.

At least one prior mechanical design provided an efficient and effective transfer of kinetic energy from one stroke to the next and also caused reversal of the pumping unit at the instant of maximum rod stretch and of maximum rod counteraction, respectively.

The design used large spiral drive and counterweight pulleys, which were awkward and expensive, and which caused accelerated wear on the drive cables because of lateral misalignment of the pulley grooves. This design enjoyed a limited commercial success.

There are many hydraulic drive pumping unit designs in the prior art, all of which, except for applicants' U.S. Pat. No. 5,536,160, have no stroke reversal system and do not effectively transfer energy or reverse the pumping unit stroke at the instant of maximum rod stretch and maximum rod contraction, respectively.

Most of these hydraulic designs utilize a pneumatic counterbalance, and none of them shows us a method for preventing a variation in the force supplied by the counterbalance from bottom to top of the stroke, which results in a variation during the stroke, in the force required from the drive system.

Many of these pneumatic counterbalance systems select a value for this counterbalance force, and a size for the counterbalance pressure vessel, or "compression space," which only partially offsets the discrepancy between the drive power required for the upstroke and for the downstroke, respectively.

Many prior hydraulic designs require extensive control systems, and a large number of components, and all of them, on average, use a counterbalance pressure storage member that is several times the size of the hydraulic drive cylinder.

None of the prior designs which utilize a pneumatic counterbalance have demonstrated a method for reducing the size of the required compression space, or pressure vessel volume which is in addition to the piston swept space of the counterbalance cylinder or accumulator, to a minimum. This compression space volume for prior designs has varied from ten times, to a minimum of three times, the volume of the piston swept portion of the counterbalance system.

Few if any of the prior art hydraulicly driven units are suggested for permanent installation of short stroke units, no doubt because the many reversals, without benefit of energy transfer from one stroke to the next, require a low cadence, along with limited production and a lack of efficiency.

Stroke velocity is limited in prior short stroke units because power must cease far enough before the end of the upstroke and downstroke that the production drag, a force approximately equal to one-half the fluid column weight, will stop movement.

The motor must be large enough to begin and accelerate each upstroke and downstroke without assistance, and also to produce proper production power before it is required to shut down some distance before the end of each stroke.

As stroke velocity and cadence of these units increases, the motor must progressively furnish more total power for acceleration and production, in a shorter time because of the increased cadence, and in a smaller percentage of each stroke because of the increased portion of each stroke required to then stop movement of the system by means of production drag.

The motor for these prior short stroke units, then, is made progressively larger as the stroke velocity and/or cadence increases, with an accompanying progressive decrease in efficiency, for units of a particular size.

Because of the above considerations, most efforts in the field of linearly driven pumping units have been directed toward long, slow stroke units, in which the problems associated with stroke reversal are minimized.

The normal variation during the stroke of the force furnished by a pneumatic counterbalance tends to assist in reversals, but the results are erratic and ineffective.

The prior long stroke units, however, are also inefficient when compared to a unit according to the subject invention which is one half their size and stroke length, which possesses a stroke reversal capability and operates at the same stroke velocity and double the cadence, and achieves the same production.

Of the prior designs within, or close to, the field of the present invention, only applicants' U.S. Pat. No. 5,536,150 offers a stroke reversal capability and a reversal which occurs at the instant of maximum rod stretch or contraction. The hydraulic/pneumatic reversal system of U.S. Pat. No. 5,536,160 requires hydraulic valving for cyclic control, and its reversal forces are controlled and transferred by means of hydraulic circuitry.

SUMMARY OF THE INVENTION

The subject invention utilizes compressed gas to store kinetic energy from the latter portion of each upstroke, and this energy is returned to the system to assist in the beginning and acceleration of the following downstroke. A separate volume of compressed gas stores kinetic energy from the latter portion of each downstroke, and this energy is returned to the system to assist in the beginning and acceleration of the following upstroke.

These two forces oppose each other, and their sum comprises a net reversal force which is zero at a point at least near the center of each upstroke and downstroke, and which builds to a maximum at respective ends of each stroke.

Pumping units which utilize this subject stroke reversal system gain many advantages, a few of which are listed below.

This invention provides, in a preferred embodiment, a pneumatic counterbalance that is altered to provide a uniform counterbalance force throughout the upstroke and the downstroke. This force is selectable and usually equals the weight of the rod string plus approximately one-half the weight of the fluid column.

The drive force then required for production is one-half the weight of the fluid column, throughout the upstroke and the downstroke. The drive force is increased above this production force by the amount selected for acceleration by the drive force.

This drive and acceleration force is added to the net reversal force at the beginning of the stroke and is continued throughout a major portion of the stroke, and there is a very substantial total surplus of force above that required for production only. This surplus force causes a relatively high rate of acceleration in the beginning portion of the stroke.

During the second half of the stroke, the opposite net reversal force builds progressively as pressure in its compressed gas builds, opposing the drive force and opposing, and slowing, movement.

Drive force is ceased at or before the instant that the increasing net reversal force has absorbed the diminishing inertial force of the system, and reversal occurs. Drive force is then begun in the opposite direction, assisted by this opposite net reversal force, etc. This sequence of events occurs during each upstroke and each downstroke.

Because the drive force is opposed by a progressively increasing net reversal force toward the end of each stroke, drive force can be applied, and its energy stored in the compressed gas, until at least near the end of the stroke. The reversal system then assists in a smooth but forceful beginning of the following stroke.

Taken together, the above characteristics of the invention allow the very efficient use of a relatively small motor which can apply power throughout at least almost the entire stroke cycle.

The subject reversal system, unlike prior art hydraulic units, allows a substantially higher cadence for a unit of a given size without a loss of efficiency. An increase in cadence does not affect efficiency adversely because all of the kinetic energy of movement is stored and returned at each end of the stroke.

An increase in cadence of a particular unit is compensated for by an increase in the pressure in the reversal gas containers and/or a change in the volume of the "compression space" which confines the compressed gasses at the end of each stroke. Drive force increases somewhat, and overall drive power is increased substantially because of the higher stroke velocity and production. The end result is that the increase in cadence has provided an increase in production for a given sized unit while maintaining production efficiency.

One of the major advantages, therefore, of the subject invention is that it makes possible a hydraulic pumping unit with a short stroke and high cadence which is very efficient. This stroke reversal system also permits a much higher cadence and stroke velocity, and improved efficiency, for long stroke units of a given size.

This stroke reversal system also permits a much higher cadence and stroke velocity, and improved efficiency, for long stroke units of a given size.

The resilient nature of the pneumatic reversal forces causes a progressive and smooth application of reversal force, and reversals occur as or after drive power is ceased and at the exact moment that the increasing reversal force is at its maximum and has absorbed all the kinetic energy of movement.

For an instant the system is in a balance: one vessel of reversal gas is at its maximum compression, and the rod string is at either its maximum contraction or maximum stretch. Then the pressure of the gas forces the beginning of movement in the other direction, the drive system joins in and the next stroke is underway.

This beginning of the next stroke occurs while the maximum rod stretch (beginning of upstroke) or maximum rod contraction (beginning of downstroke) is still intact. The forceful beginning of the stroke prevents rapid dissipation of the stretch or contraction, and it is absorbed by the rod string over a large initial part of the stroke. Likewise, the contraction or stretch for the other end of the stroke begins after the middle of the stroke, and it builds gradually to the end of the stroke.

The exact lower and upper limits of the stroke are not determined mechanically, but by all the factors of operation: gas pressure, drive force and cadence, rod weight and stretch characteristics, etc.

The reversal of the polish rod coincides with the reversal of the entire rod string, including its lower end, because the rod string is at its maximum stretch or contraction at the time that the affected container of gas is at its maximum pressure.

The result is the elimination of at least most of the usual parasitic rod string oscillation due to reversal. Also, because of the operational characteristics of the subject reversal system, proper timing of the application of power and removal of power eliminates most oscillation problems connected with drive force.

The value of the net reversal forces can be adjusted by changing the reversal gas pressures and/or the total volume of the compression spaces, the vessels containing the reversal gas. The maximum value of the net reversal force can be selected and can be as much as one gravity force. When required, the net upstroke reversal force can differ from the net downstroke reversal force in maximum force, location of beginning, etc.

The operation of the reversal system is completely automatic and requires no cyclic controls. Construction is simple, with very few moving parts. One preferred form of the subject invention, when compared to a popular general design for hydraulic pumping units with a pneumatic counterbalance and with no reversal capability, requires no additional moving parts.

The subject invention, in some embodiments, combines the stroke reversal function with the pneumatic counterbalance function for simplicity and economy of construction and maintenance.

The system is adjusted to automatically compensate for the variation in force normally supplied by a pneumatic counterbalance, from top to bottom of the stroke, eliminating the requirement that the drive force varies accordingly.

Pneumatic counterbalances require a compression space in addition to their piston swept space, in order to provide a controlled and selected increase in the counterbalance pressure and force as the stroke approaches its bottom position. In prior art designs that compression space volume has varied from ten times, to a minimum of three times the piston swept volume.

The subject invention provides an embodiment with a minimum compression space volume, in combination with the stroke reversal system, of approximately two thirds the volume of the piston swept space. This results in a more compact and less expensive unit.

Hydraulicly driven embodiments of the subject design can use either fixed or variable displacement pumps. The fixed displacement pump is less expensive but allows less operating flexibility, while the variable displacement pump allows a greater variation of velocity along the stroke, and uses to greater advantage the energy transfer capabilities of the subject reversal system.

Competition in the modern oil production industry creates a need for pumping units that are relatively inexpensive, easy to maintain and operate, that are energy efficient and deliver a high production for a unit of a given size.

It is the object of this invention to make possible pumping units which satisfy the industry requirements of the paragraph above, to overcome the previously listed objections to pumping units of the prior art, and to furnish other advantages.

DETAILED DESCRIPTION OF THE DRAWINGS

Drawings FIGS. 1 through 8 are schematic drawings of pumping units 1 through 8, each of which demonstrates an embodiment of the subject pumping unit stroke reversal system. Pumping units 1 through 8 are examples for the application of the subject invention, and are not meant to be restrictive. The invention is restricted only by the attached claims.

FIGS. 9 through 15 are graphs which demonstrate the possible selected variations in the magnitude of the reversal forces, and other forces, for various embodiments, throughout the stroke cycle.

Figure 16:
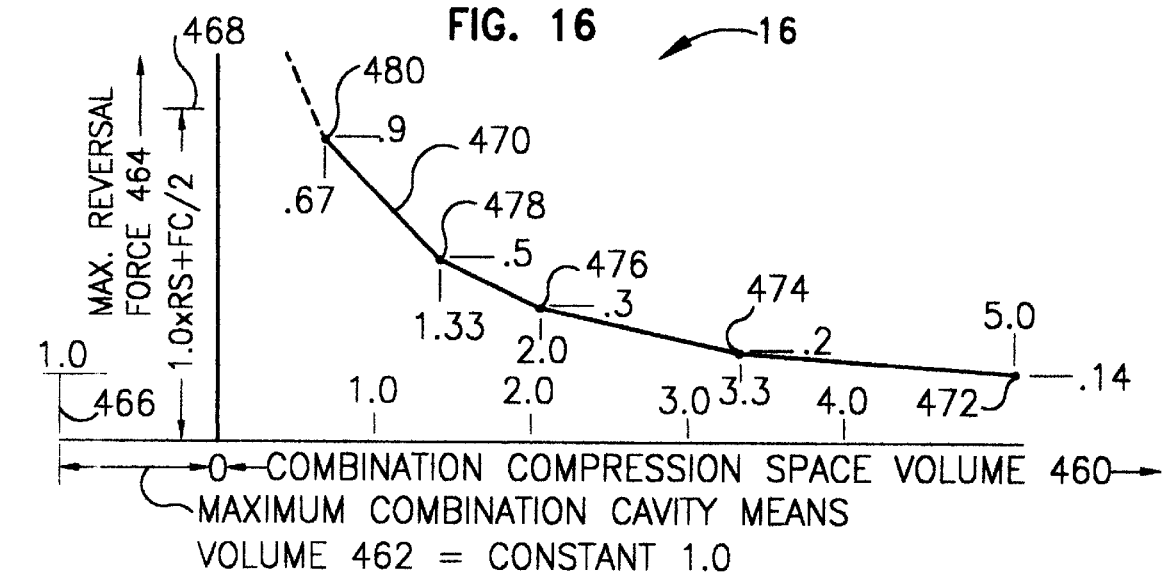
FIG. 16 is a chart, applicable to pumping units 5, 6, 7, and 8, which shows the approximate maximum value of the net progressive reversal forces produced by respective values for the volume of the combination counterbalance and downstroke reversal compression space.

FIG. 16 demonstrates the maximum value of the net reversal forces in relation to the combination compression space volume.

Figure 1:
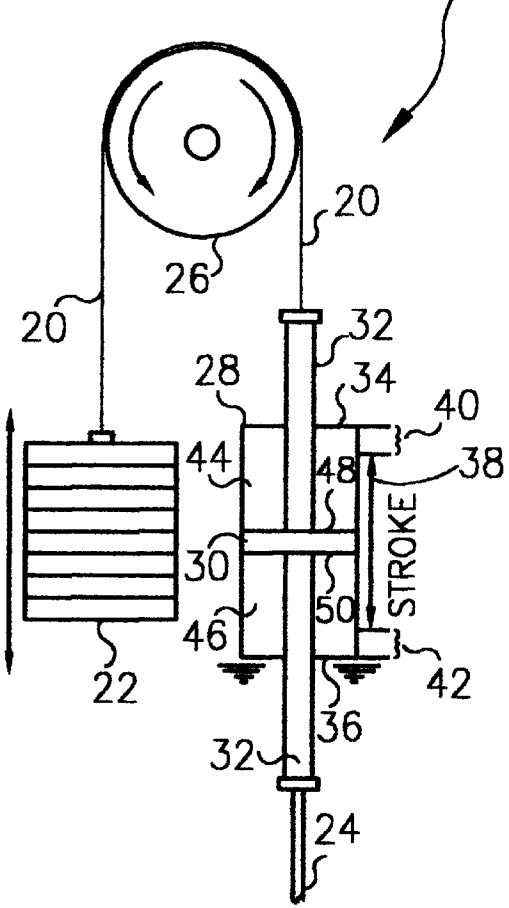
FIG. 1 is a schematic drawing of pumping unit 1, which comprises a mechanical drive and a mechanical counterbalance, along with a single pneumatic cylinder for upstroke and downstroke reversal.

Pumping unit 1, shown in FIG. 1, is mechanically driven by means of drive/support cable 20, which supports mechanical counterweight 22 at its one end and polish rod 24, which is connected to the rod string and downhole pump, which are not shown, at its other end. Sprocket 26 supports drive/support cable 20 and mechanically imparts a reciprocating movement to it.

The stroke reversal mechanism for pumping unit 1 comprises pneumatic reversal cylinder 28, which comprises reversal piston 30 and double ended shaft 32 which is connected to drive/support cable 20 and polish rod 24, respectively. Reversal cylinder 28 is supported in a stationary manner, is aligned vertically, and is co-axial with drive/support cable 20 and polish rod 24.

The reciprocating stroke of unit 1 moves reversal piston 30 only to within a short distance from ends 34 and 36, respectively, of reversal cylinder 28. The stroke 38 is indicated in FIG. 1, as is the upstroke reversal compression space 40 and the downstroke reversal compression space 42. Reversal piston 30 reciprocally sweeps the space indicated by stroke 38 during each stroke, but does not enter upstroke reversal space 40 or downstroke reversal space 42.

In the pumping unit 1 embodiment, reversal piston 30 functions as both upstroke reversal piston 30 and downstroke reversal piston 30. When reversal piston 30 is at its maximum height, nearest end 34 of reversal cylinder 28, upstroke reversal cavity 44 is at its minimum, zero volume, and only upstroke reversal compression space 40 remains above reversal piston 30.

When reversal piston 30 is at its lowest location, nearest end 36 of reversal cylinder 28, downstroke reversal cavity 46 is at its lowest, zero volume, and only downstroke reversal compression space 42 remains below reversal piston 30.

A selected amount of compressed gas is contained in upstroke reversal cavity 44 and upstroke reversal compression space 40, and respectively, in downstroke reversal cavity 46 and downstroke reversal compression space 42. These two bodies of gas exert varying, opposing forces upon upper face 48 and lower face 50 of reversal piston 30, and the sum of these forces comprises a downwardly directed net upstroke reversal force which is zero at a common point at least near the center of the stroke, and greatest at the top of the stroke, and an upwardly directed net downstroke reversal force which is zero at the above common point at least near the center of the stroke, and greatest at the bottom of the stroke. Refer to common point 285, near the center 287 of stroke 288, of chart 9 of FIG. 9.

Characteristics of the stroke are controlled by selections of the respective amounts of gas and the selected respective sizes of upstroke reversal compression space 40 and downstroke reversal compression space 42.

Figure 9:
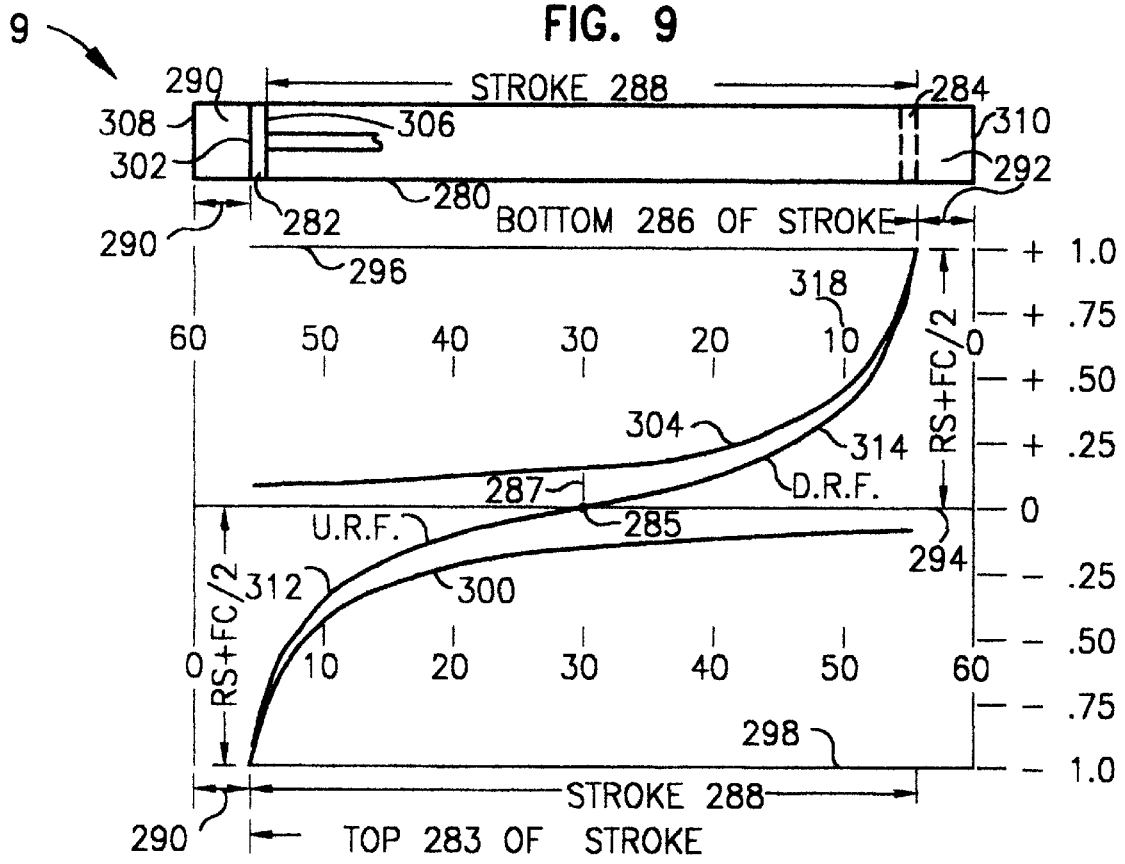
FIG. 9 is a chart of the upstroke reversal and downstroke reversal forces, along with the net reversal force along the stroke of pumping unit 1. Maximum net reversal force is approximately one gravity, and the end points of the pneumatic cylinder piston are indicated, as are the size of the compression spaces.
Figure 10:
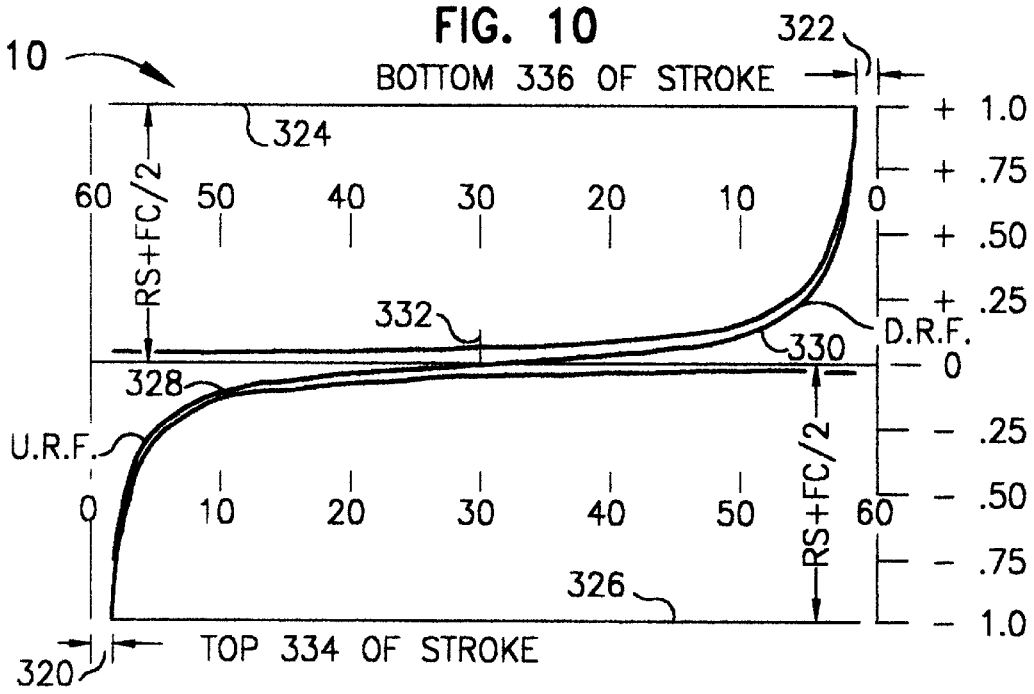
FIG. 10 is a chart which illustrates the later and more abrupt reversal forces which are obtained by using a lower gas pressure and a smaller size for the compression space, for pumping unit 1.

Charts 9 and 10 of FIGS. 9 and 10 illustrate graphicly the magnitude of the reversal, and other, forces which apply throughout the stroke cycle of pumping unit 1. These drawing figures will be explained in detail in their turn.

Figure 2:
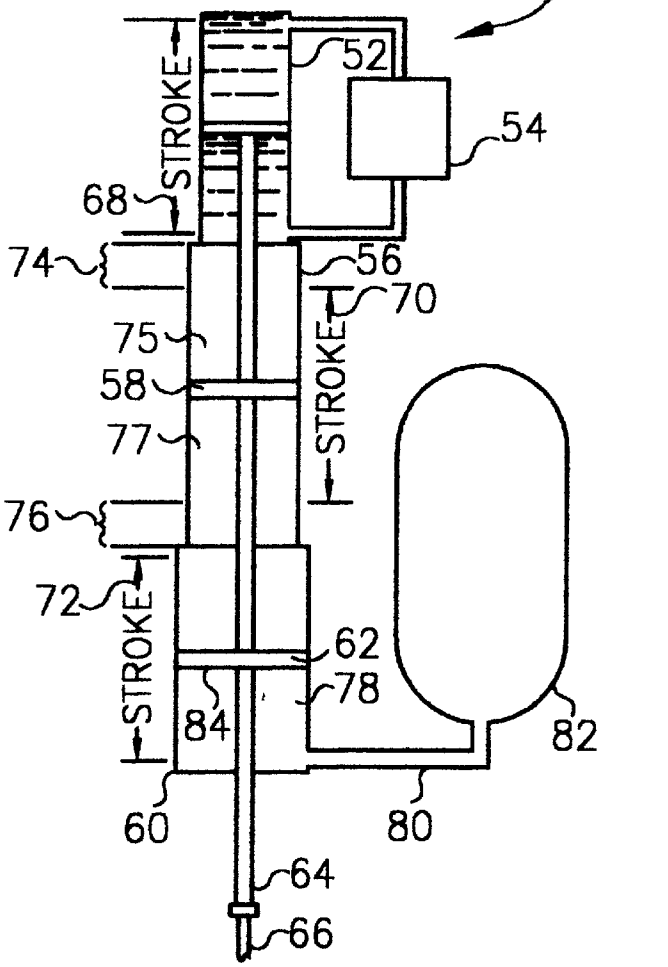
FIG. 2 is a schematic drawing of pumping unit 2, which comprises respective separate cylinders for stroke reversal, hydraulic drive, and pneumatic counterbalance.

FIG. 2 shows pumping unit 2, which uses a hydraulic drive cylinder 52 which is powered by a reversible hydraulic power assembly 54, and which uses a pneumatic counterbalance system.

Pneumatic reversal cylinder 56 contains reversal piston 58, and pneumatic counterbalance cylinder 60 contains counterbalance piston 62.

Drive cylinder 52, reversal cylinder 56, and counterbalance cylinder 60 are connected in series and have a common shaft means 64 which is connected to polish rod 66. The stroke 68 of drive cylinder 52, the stroke 70 of reversal cylinder 56, and the stroke 72 of counterbalance cylinder 60 are indicated and are equal.

The length of reversal cylinder 56 is greater than that of drive cylinder 52 and counterbalance cylinder 60, in order to accommodate upstroke reversal compression space 74 and downstroke reversal compression space 76. Reversal piston 58 sweeps only the portion of reversal cylinder 56 indicated by stroke 70.

Counterbalance cylinder 60 comprises counterbalance cavity 78 below counterbalance piston 62, which is connected by conduit 80 to counterbalance compression vessel 82, which is substantially larger than the maximum size of counterbalance cavity 78, in order to minimize the variation during the stroke in counterbalance pressure applied to the underside 84 of counterbalance piston 62.

Counterbalance compression vessel 82 contains an amount of pressurized gas sufficient to cause an upward force upon piston 62 which varies, but averages approximately the weight of the rod string plus one-half the weight of the fluid column of the well.

Charts 11 and 12, of FIGS. 11 and 12, apply to pumping unit 2, as well as to pumping units 3 and 4, of FIGS. 3 and 4, all of which will be described in detail in their turn.

Figure 3:
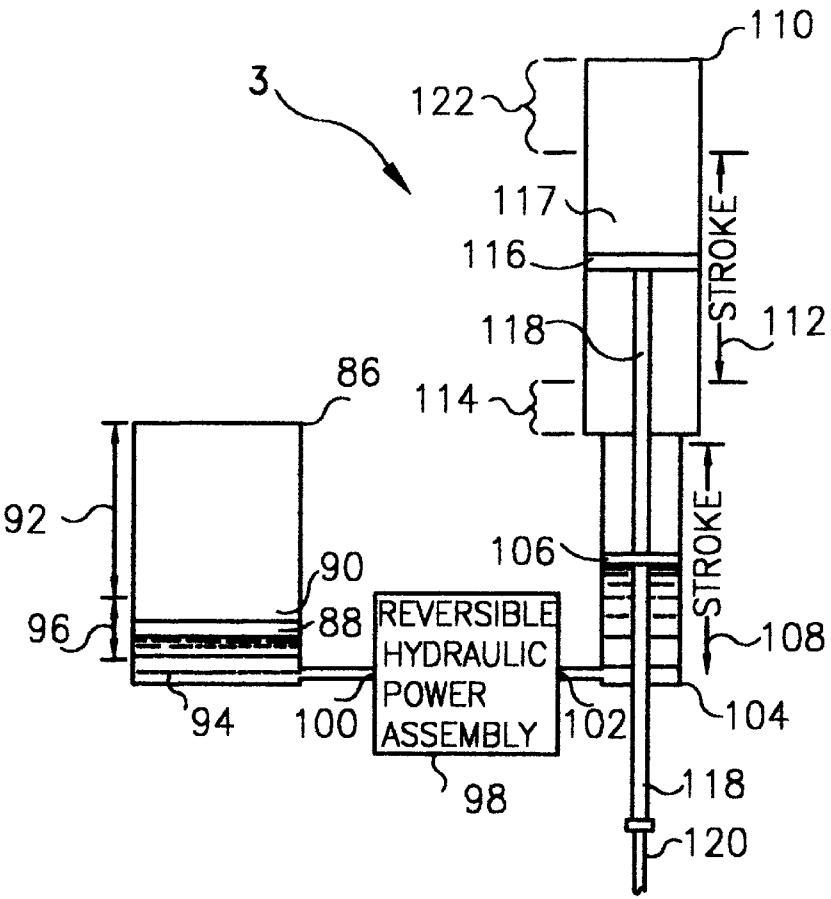
FIG. 3 is a schematic drawing of pumping unit 3, an embodiment of the invention in which the hydraulic drive system utilizes one cavity in each of two cylinders, one of which cylinders contains in its other cavity a pneumatic counterbalance, and a third pneumatic cylinder is utilized for the upstroke and downstroke reversals.

FIG. 3 shows pumping unit 3, an embodiment of the present invention in which hydraulic/pneumatic cylinder 86 furnishes a counterbalance force. Its counterbalance piston means 88 is a free piston 88 which separates counterbalance cylinder 86 into counterbalance cavity means 90 and counterbalance compression space 92 on its first side, and a drive fluid cavity 94 on its second side.

The reciprocal movement range of counterbalance piston 88 during the stroke cycle is designated at 96, which is also the portion of cylinder 86 which comprises counterbalance cavity 90.

Reversible hydraulic power assembly 98 is connected to drive fluid cavity 94 of cylinder 86 from its first outlet 100, and to hydraulic drive cylinder 104 from its second outlet 102.

Hydraulic fluid is pumped from cylinder 86 and into cylinder 104 during the upstroke, and from cylinder 104 into cylinder 86 during the downstroke. The gas pressure in counterbalance compression space 92 transfers a force hydraulicly to work against the lower face of drive piston 106, which balances the weight of the rod string and part of the weight of the fluid column so that power assembly 98 applies at least approximately the same amount of power during the upstroke and during the downstroke.

The stroke 108 of cylinder 104 is much longer than stroke 96 of cylinder 86, but the hydraulic displacement is the same because of the difference in their diameters.

Reversal cylinder 110 has a stroke length indicated at 112, downstroke reversal compression space 114, and a reversal piston 116 attached to shaft 118 which is common to cylinder 104 and is connected to polish rod 120.

Upstroke reversal compression space 122 is larger than downstroke reversal compression space 114 in order to offset the difference in the pneumatic counterbalance force from bottom to top of the stroke. Chart 11 shows this imbalance which occurs in connection with pumping unit 2, and chart 12 shows the corrected result as provided by pumping units 3 and 4.

These charts are discussed in detail in turn, and it is noted that a selected variation of the volume and/or pressure of the upstroke and/or downstroke reversal compression space will offset the imbalance of the pneumatic counterbalance.

In applications in which an imbalance between the net upstroke reversal force and the net downstroke reversal force are required, a selected imbalance can be produced by manipulation of the volumes of compression spaces 92, 114, and 122, and their amounts of gas, respectively.

Figure 4:
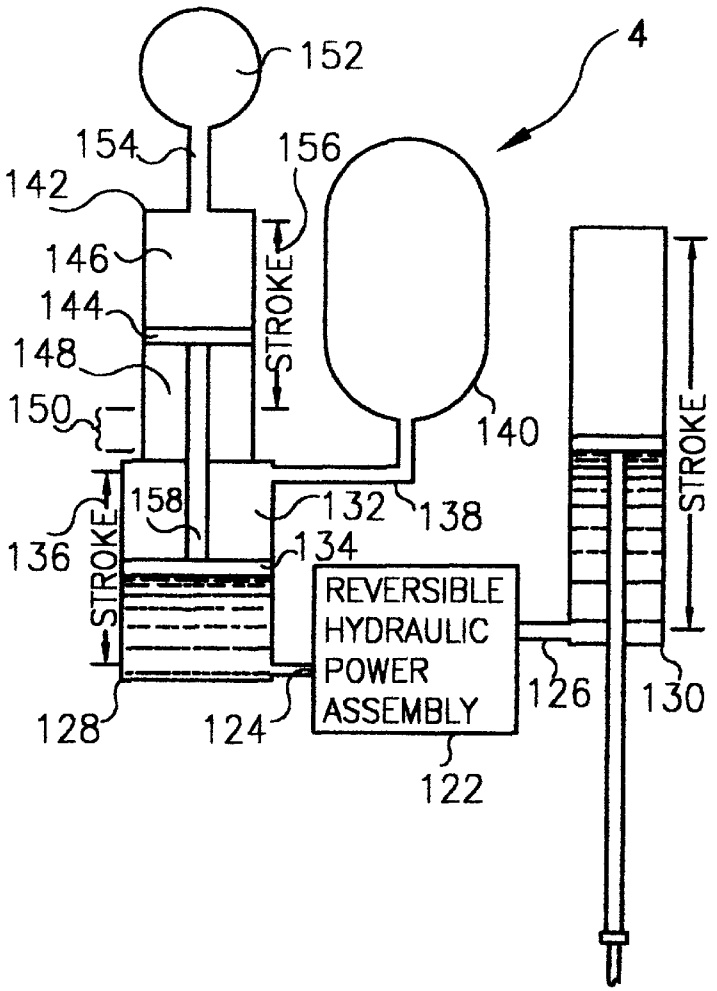
FIG. 4 is a schematic drawing of pumping unit 4, which comprises a smaller counterbalance cavity connected to a separate counterbalance compression vessel, the downstroke reversal cavity is also smaller and connected to a separate downstroke reversal compression vessel.

Pumping unit 4, of FIG. 4, is very similar in its operation to pumping unit 3, but there are major differences in its components and their arrangement.

Reversible hydraulic power assembly 122 is joined at its two outlets 124 and 126 to counterbalance cylinder 128 and drive cylinder 130 respectively, and pumps fluid between the two during the upstroke, and respectively, the downstroke. Counterbalance cylinder 128 comprises counterbalance cavity 132, and counterbalance piston 134, which, as indicated by stroke 136, sweeps at least almost all of cylinder 128 during the stroke cycle.

Counterbalance cavity 132 is connected by conduit 138 to counterbalance compression space 140, which comprises counterbalance pressure vessel 140.

Reversal cylinder 142 is divided by reversal piston 144 into downstroke reversal cavity 146 and upstroke reversal cavity 148 which joins upstroke reversal compression space 150. Downstroke reversal compression space 152 is joined to downstroke reversal cavity 146 by conduit 154, and comprises downstroke reversal pressure vessel 152.

Stroke 156 indicates the range of movement of reversal piston 144, which is joined to shaft 158 which is also joined to piston 134 of counterbalance cylinder 128.

Pumping units 5, 6, 7, and 8, of FIGS. 5, 6, 7, and 8, simplify the mechanisms and eliminate at least one major component by combining the downstroke reversal function with the pneumatic counterbalance function, and they provide a smoothly progressive net reversal force, the maximum volume of which can be selected over a wide range.

The upstroke reversal function, in pumping units 5, 6, and 7, occupies a part of a cylinder separate from a second cylinder, a part of which comprises the combined downstroke reversal and counterbalance function. In pumping unit 8, a single pneumatic cylinder comprises the upstroke reversal function and the combined downstroke reversal and counterbalance function.

Figure 13:
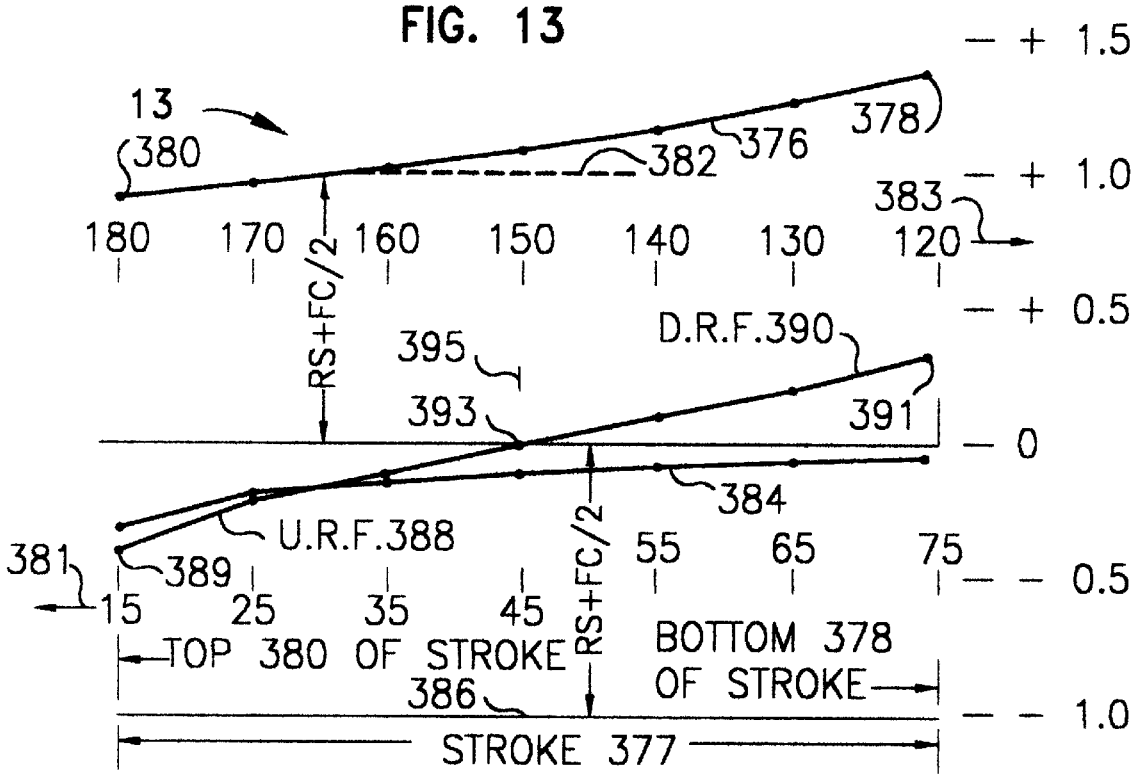
FIG. 13 is a chart showing the forces which apply in pumping units 5, 6, 7, and 8, and showing the sum of the primary forces which comprises the net progressive upstroke and downstroke reversal forces, the maximum value of which is approximately 0.3 G.
Figure 14:
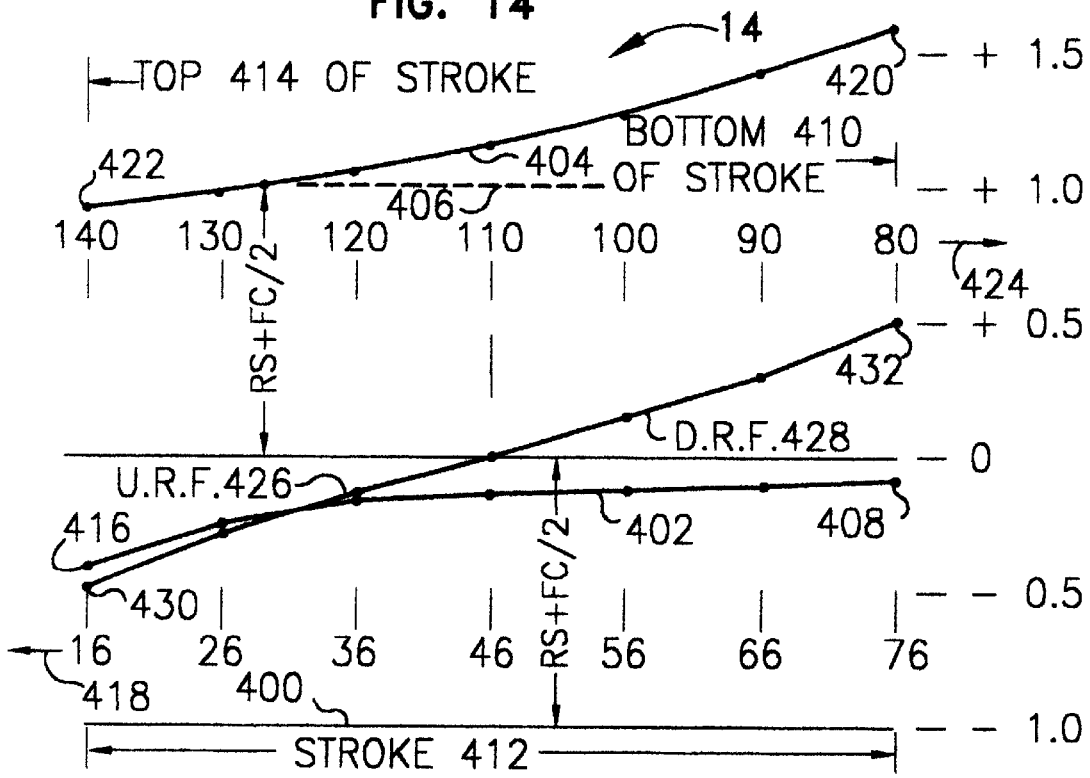
FIG. 14 applies to pumping units 5, 6, 7, and 8, and shows a selection of primary forces which yield progressive net upstroke and downstroke reversal forces which have a maximum value of approximately 0.5 G.
Figure 15:
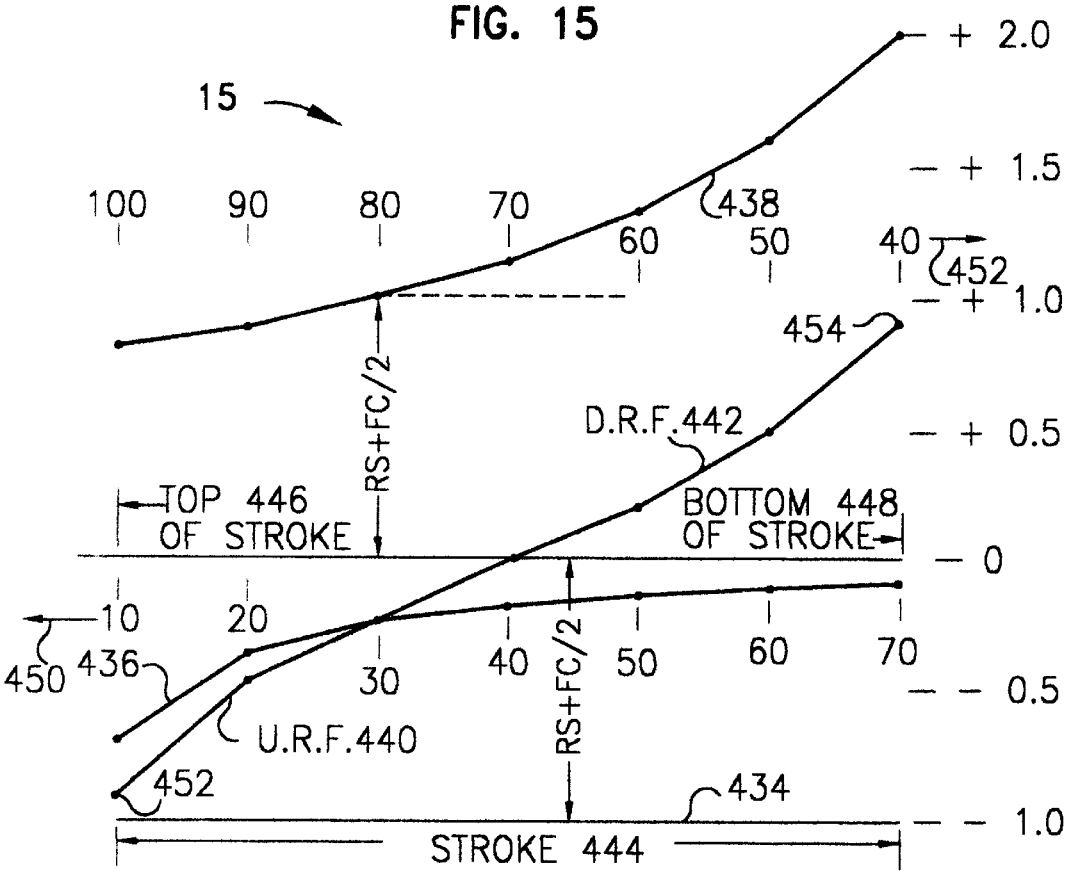
FIG. 15 applies to pumping units 5, 6, 7, and 8, and shows a selection of primary forces which yield progressive net upstroke and downstroke forces with a maximum value of approximately 0.9 G.

Charts 13, 14, and 15, of FIGS. 13, 14 and 15, show a sampling of the reversal characteristics and forces which are produced by proper selection of the size of, and gas pressures within, the upstroke reversal compression space and the combination downstroke reversal and counterbalance compression space.

Pumping units 5 and 6 are at least almost identical in their operation and in their reversal characteristics, and they illustrate two different embodiments of the combination compression space and the upstroke reversal compression space, respectively.

Pumping unit 5 comprises reversible hydraulic power assembly 160, its two outlets 162 and 164 connected, respectively, to combination counterbalance and downstroke reversal cylinder 166, which comprises combination force cylinder 166, and to upstroke reversal cylinder 168. Upstroke reversal cylinder 168 comprises upstroke reversal piston 170, which divides cylinder 168 into drive cavity 172 and upstroke reversal cavity 174, and is connected to shaft 176 which is connected to the rod string of the well, which is not shown.

The stroke 178 of piston 170 is indicated, and the upstroke reversal compression space 180 occupies the remainder of cylinder 168 which is above the piston swept stroke portion 178 of cylinder 168.

Combination force cylinder 166 houses combination piston means 182, which comprises free piston 182, which divides combination force cylinder 166 into drive cavity 184 and combination cavity 186. The stroke 188 of combination piston 182 is indicated, and the remainder of combination cylinder 166, which remains beyond the portion 188 swept by combination piston 182, comprises combination compression space 190.

The relative volumes of the piston swept portions 188 and 178 of cylinders 166 and 168 are identical, and their lengths 188 and 178, and their diameters 167 and 169, respectively, are selected to satisfy stroke length and force requirements of a particular installation.

The volume of combination compression space 190 and upstroke reversal compression space 180, respectively, and the amount of compressed gas in combination compression space 190 and combination cavity means 186, and, respectively, the amount of compressed gas in upstroke reversal compression space 180 and upstroke reversal cavity means 174, are all selected to produce the desired forces and stroke reversal characteristics.

Pumping unit 5 demonstrates the approximate relative size of these components in one preferred embodiment of the subject invention.

Figure 6:
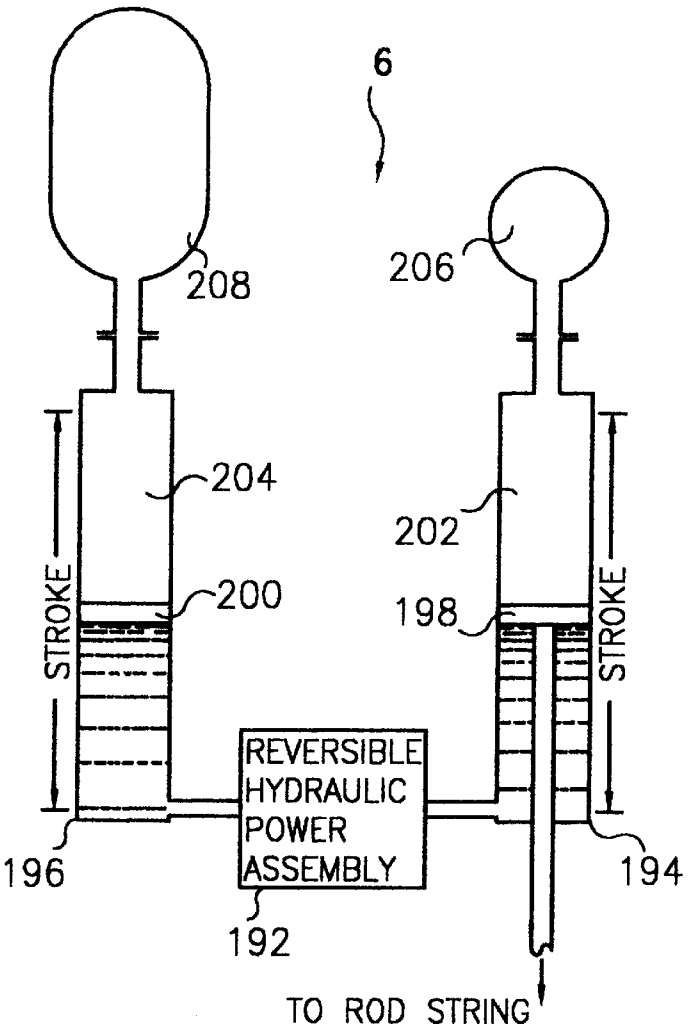
FIG. 6 is a schematic drawing of pumping unit 6, in which the compression space required for the upstroke reversal, and for the combination counterbalance and downstroke reversal, is furnished by attached, separate, respective pressure vessels.

Pumping unit 6 of FIG. 6, is very similar to pumping unit 5, and only the differences will be discussed in detail.

Reversible hydraulic power assembly 192 is connected to upstroke reversal cylinder 194 and to combination force cylinder 196. At least almost all of cylinders 194 and 196 are swept by piston 198 and piston 200, respectively.

Upstroke reversal cavity 202 varies in size, during the stroke cycle, from at least almost zero to at least almost the entire size of upstroke reversal cylinder 194, and combination cavity 204 varies in size, during the stroke cycle, from at least almost zero to at least almost the entire size of combination force cylinder 196.

Upstroke reversal compression space 206 comprises pressure vessel 206, and combination compression space 208 comprises pressure vessel 208. One advantage of the embodiment of pumping unit 6 is that the respective pressure vessels 206 and 208 can be substituted with different sizes as required.

Figure 7:
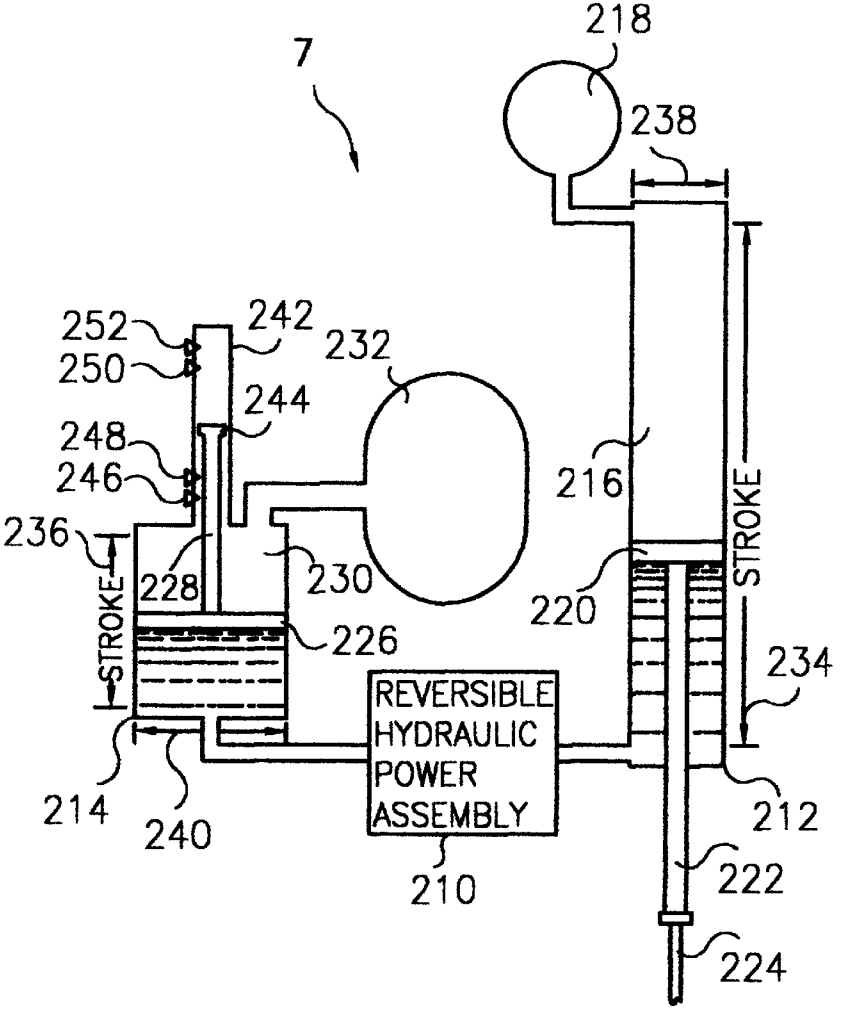
FIG. 7 is a schematic drawing of pumping unit 7, which is similar to pumping unit 6, and which comprises a shortened second cylinder with a greater diameter, which utilizes an enclosed control shaft and switch system.

Pumping unit 7, of FIG. 7, is similar to pumping unit 6. It comprises reversible hydraulic power assembly 210, which is connected to upstroke reversal cylinder 212 and to combination force cylinder 214. Upstroke reversal cavity 216 is connected to upstroke reversal pressure vessel 218, and upstroke reversal piston 220 is attached to shaft 222 which supports rod string 224.

Combination force cylinder 214 contains free piston 226 which supports control shaft 228. Combination cavity 230 of cylinder 214 is connected to combination pressure vessel 232, which comprises the combination compression space 232 of pumping unit 7.

The respective strokes 234 and 236, of cylinders 212 and 214, are unequal, as are their respective diameters, 238 and 240. Their total volumes are equal, and at least almost entirely swept by pistons 220 and 226, respectively, during the stroke cycle.

In the embodiment of the invention shown in FIG. 7, the stroke 234 of upstroke reversal cylinder 212 is relatively long to furnish a required pumping stroke length, and combination force cylinder 214 is much shorter to provide a convenient combination of components, including cylinder extension 242, which receives control shaft 228 and its contact portion 244 which contacts, in turn, switches 246, 248, 250, and 252. In some embodiments these switches dictate the limits of operation of the drive force, and/or indicate a failure of the stroke to conform to minimum or maximum position limits.

Figure 8:
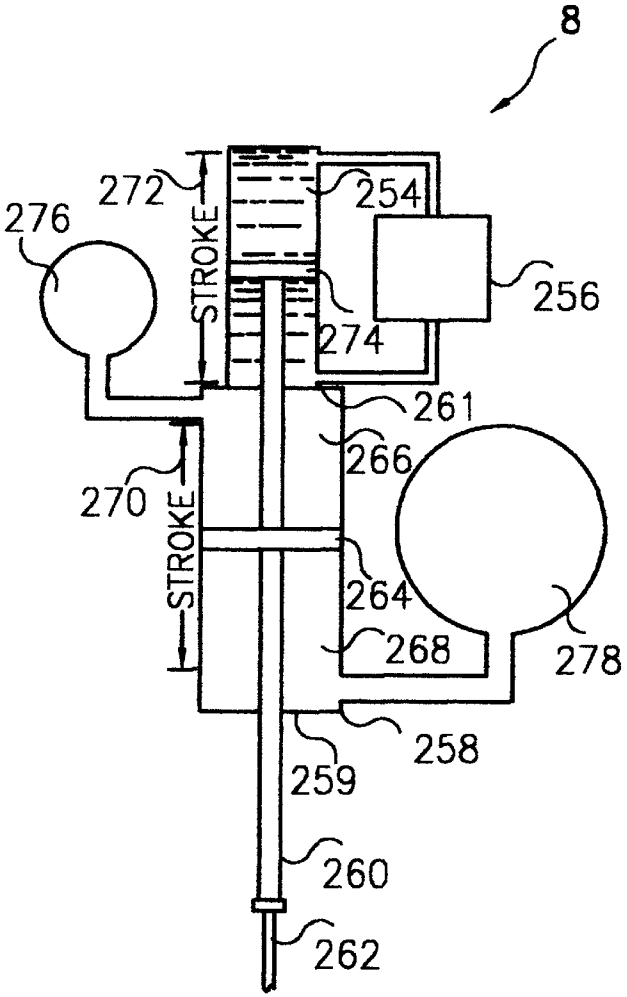
FIG. 8 is a schematic drawing of pumping unit 8, which comprises a single cylinder for hydraulic drive, and a second, pneumatic cylinder which, along with separate pressure vessels, comprises the upstroke reversal system and the combination counterbalance and downstroke reversal system, respectively.

FIG. 8 is a schematic drawing of pumping unit 8, which employs a conventional hydraulic drive cylinder 254 powered by a reversible hydraulic power assembly 256, along with a pneumatic cylinder 258 which provides the downward upstroke reversal force and the upward combination force of downstroke reversal and counterbalance.

Shaft 260 supports rod string 262, and is common to hydraulic drive cylinder 254 and to pneumatic cylinder 258, in which it supports piston 264, which divides cylinder 258 into upstroke reversal cavity means 266 and combination downstroke reversal and counterbalance cavity means 268. Piston 264 serves as both upstroke reversal piston means 264 and combination force piston means 264.

Stroke 270 of piston 258 and stroke 272 of piston 254 are indicated, and are equal. Piston 264 sweeps at least almost all of cylinder 258, and upstroke reversal compression space 276 is provided by pressure vessel 276, and combination compression space 278 is provided by pressure vessel 278.

FIG. 9 shows chart 9, which illustrates the balance and reversal forces at work in pumping unit 1 of FIG. 1, at points along the upstroke and the downstroke.

Reversal cylinder 280 of FIG. 9 corresponds to reversal cylinder 28 of pumping unit 1, with its relative dimensions altered to better illustrate the forces along its stroke 288. Piston 282 is shown at its uppermost position at the top 283 of stroke 288 and in shadow form 284 in its lowest position at the bottom 286 of the stroke 288.

Upstroke reversal compression space 290 and downstroke reversal compression space 292 are indicated at respective ends 308 and 310 of reversal cylinder 280, and correspond to upstroke reversal compression space 40 and downstroke reversal compression space 42 of reversal cylinder 28 in FIG. 1.

Forces above the zero line 294 of chart 9 are positive, or upward forces, and those below zero line 294 are downward, or negative, forces. Line 296 shows the consistent upward force furnished by counterweight 22 of pumping unit 1 throughout stroke 288, and line 298 shows the consistent downward force which comprises the weight of the rod string plus one-half the weight of the fluid column. The counterweight 22 has a selected weight which is equal to the weight of the rod string plus one-half the weight of the fluid column. These two forces offset each other at all points along stroke 288, and their values are respectively abbreviated on charts 9 through 16 as RS+FC/2.

The drive system furnishes a force, during upstroke and during downstroke, of one-half the weight of the fluid column, to balance the system, and it also provides the additional amount selected for acceleration. The drive system forces are not shown on the charts in order to emphasize the net reversal forces and their components.

There is a selected amount of compressed gas in each respective cavity of cylinder 280 and this produces the downwardly directed upstroke reversal force 300 upon face 302 of piston 282, and the upwardly directed downstroke reversal force 304 upon face 306 of piston 302.

These forces 300 and 304 vary throughout the stroke as platted on chart 9. The force exerted by the compressed gas, multiplied by the distance between the piston 282 and the respective end 308 or 310 of cylinder 280, at any point along the stroke 288, is equal to a constant product.

As indicated on chart 9, upstroke reversal force 300 is a negative force which is least at the bottom 286, and greatest at the top 283, of stroke 288, and downstroke reversal force 304 is a positive force which is least at the top 283, and greatest at the bottom 286, of stroke 288. The respective maximums for these two forces are approximately one times the weight of the rod string plus one-half the fluid column weight, or RS+FC/2.

These two forces are added together at their contact with piston 282, and are also added to forces 296 and 298, which respectively are transferred mechanically to the two ends of shaft 32, and the resulting total force comprises the net upstroke reversal force 312 and the net downstroke reversal force 314.

These two net reversal forces 312 and 314 are zero at a common point 285 at least near the center 287 of the stroke 288, and are maximum at the top 283 of the stroke 288, and at the bottom 286 of the stroke 288, respectively. These two forces are referred to on the charts in abbreviated form as N.U.R.F. and N.D.R.F. respectively, and their respective maximum values are illustrated as just under one times the weight of the rod string plus one-half the weight of the fluid column.

If a less forceful reversal is indicated, the stroke length 288 can be reduced and the upstroke 290 and downstroke 292 compression spaces, respectively, increased, for instance to the horizontal 10's, #316 and #318, respectively, and the maximum net reversal forces 312 and 314 are reduced by more than one-half.

This same result can be achieved by lengthening cylinder 280, maintaining the same stroke length 288, and increasing upstroke reversal compression space 290 and downstroke reversal compression space 292.

FIG. 10 shows chart 10 which applies to pumping unit 1 and which illustrates the result of reducing upstroke reversal compression space 320 and downstroke reversal compression space 322. Upward counterweight force 324 and the downward RS+FC/2 force 326 are unchanged from chart 9, and the net upstroke reversal force 328 and net downstroke reversal force 330 begin more gradually after the center 332 of the stroke, and are more progressive toward the ends 334 and 336 of the stroke.

Figure 11:
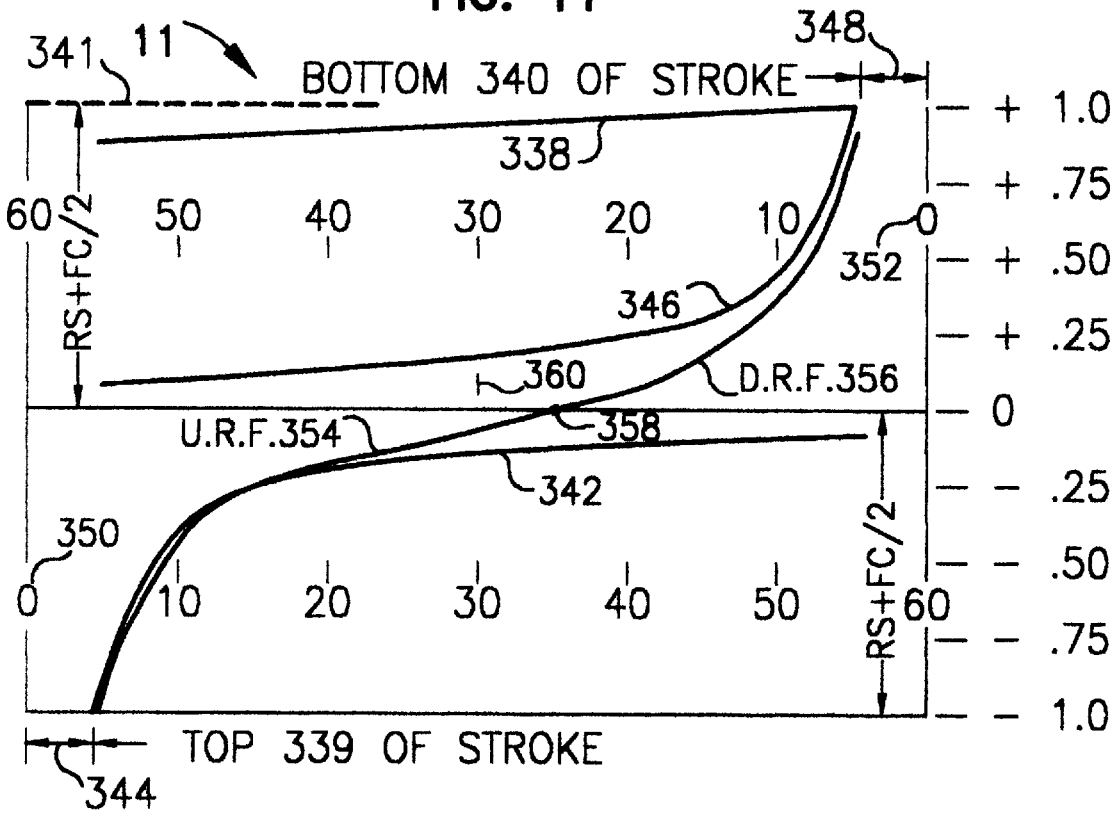
FIG. 11 is a chart showing a varying pneumatic force furnished by the counterbalance systems of pumping units 2, 3, and 4, and the imbalance it produces in the net reversal force, if not corrected.

FIG. 11 is a chart which shows one example of the forces produced by pumping units 2, 3, and 4, each of which comprises pneumatic counterbalance components which produce a somewhat varying counterbalance force 338, FIG. 11, the maximum value of which is approximately RS+FC/2 at the bottom 340 of the stroke. Counterbalance force 338 decreases toward the top 339 of the stroke, and a dashed line 341 is placed at the force values of RS+FC/2 for reference purposes.

Upstroke reversal force 342 and upstroke reversal compression space 344 are indicated, as are downstroke reversal force 346 and downstroke reversal compression space 348. While the stroke 70 and compression spaces 74 and 76 are contained within cylinder 56 of pumping unit 2 of FIG. 2, the counterbalance compression vessel 82 is several times the size of the piston swept volume of counterbalance cylinder 60 of FIG. 2, in order to minimize the variation of force 338 of FIG. 11.

In chart 11, the cylinder end points for the upstroke reversal curve 342 and the downstroke reversal curve 346 are horizontal zero points 350 and 352, respectively. If the volume of counterbalance compression space vessel 82, of FIG. 2, is considered as an extension of cylinder 60, then the end point of cylinder 60, on chart 11, would be several times the total horizontal dimension of chart 11, to the right side.

In other words, the counterbalance compression space 82 of FIG. 2, must be several times the piston swept volume of counterbalance cylinder 60 in order to properly minimize the variation of the counterbalance force 338 throughout the stroke.

The net upstroke reversal force (N.U.R.F.) 354 is shown, along with the net downstroke reversal force (N.D.R.F.) 356, and their common zero force point 358 which, because of the variation of counterbalance force 338, is removed from the center 360 of the stroke.

The maximum values, respectively, of the net upstroke reversal force 354 and the net downstroke reversal force 356 are shown in the illustration as just under RS+FC/2, but can be designed as greater or less by adjustment of total stroke length 70 of pumping unit 2, upstroke 74 and downstroke 76 compression spaces, and/or adjustment of the amount of gas in the upstroke reversal cavity 75 and compression space 74, and the amount of gas in downstroke reversal cavity 77 and compression space 76, all of pumping unit 2 of FIG. 2.

Figure 12:
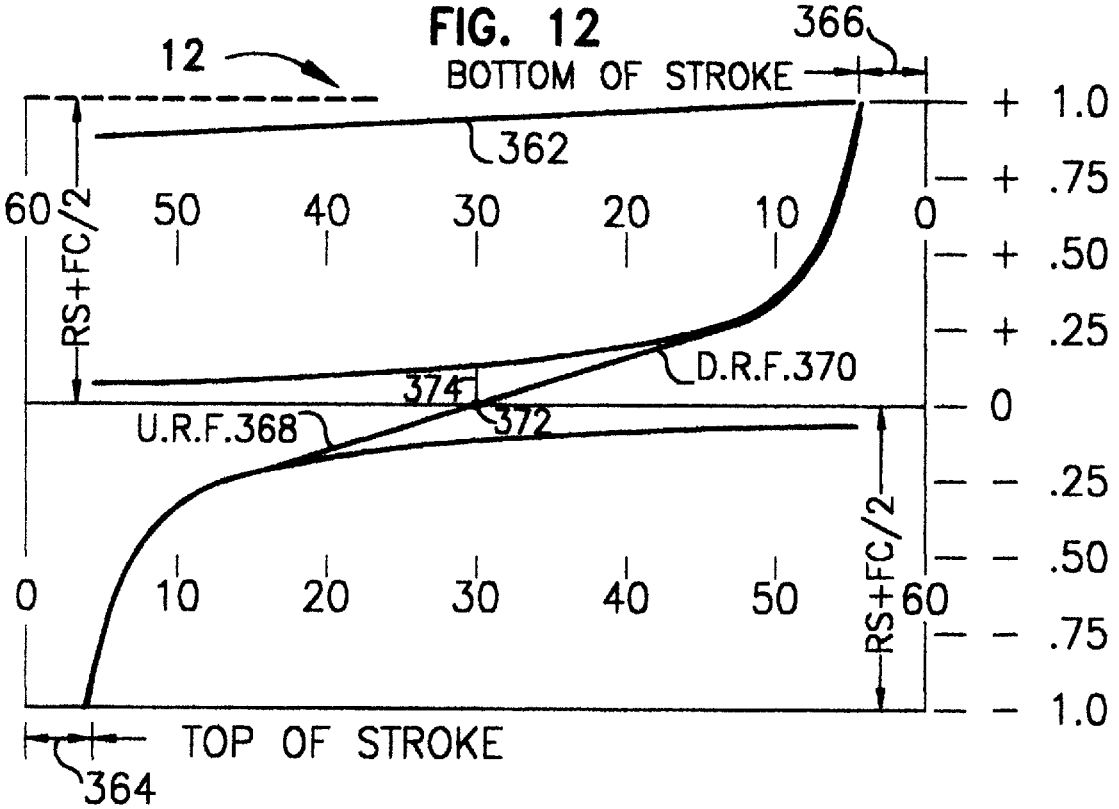
FIG. 12 shows the beneficial effect produced upon pumping units 2, 3, and 4, by adjustment of the gas pressures and or compression space sizes to offset the variable counterbalance pressure.

FIG. 12 comprises chart 12, which depicts the operation of pumping units 3 and 4, which is very similar to the operation of pumping unit 2, described immediately above, except that adjustments have been made in the size of upstroke reversal compression space 122 of pumping unit 3 and 152 of pumping unit 4, along with adjustments in the amount of gas in upstroke reversal cavity 117 and upstroke reversal compression space 122 of pumping unit 3 and the amount of gas in upstroke reversal cavity 146 and upstroke reversal compression vessel 152 of pumping unit 4.

Chart 12 shows counterbalance force 360, which is unchanged from force 338 of chart 11, and the upstroke reversal compression space 364 and the downstroke reversal compression space 366, the ratio of the two of which has been adjusted.

The net upstroke reversal force 368 and the net downstroke reversal force 370 are shown, along with their common zero point 372, which, because of the adjustment, now occurs at the center 374 of the stroke.

Charts 11 and 12 are furnished partly to demonstrate the imbalance in the subject reversal system caused by a pneumatic counterbalance, and a method for removing the imbalance.

In like manner, when a particular application requires a built in imbalance in the reversal system, proper design of the subject system can provide it.

Although the components in pumping units 3 and 4 are arranged differently, there is very little difference in their operation. Pumping unit 4 has a cost and adjustment advantage in that its cylinder 128 is much smaller than cylinder 86 of pumping unit 3 and more efficient in its utilization of total machined cylinder space, and pressure vessels 140 and 152 of pumping unit 4 can be easily substituted in other sizes by design or in the field, to adjust operational characteristics.

FIG. 13, FIG. 14, and FIG. 15 contain charts number 13, 14, and 15, which show net upstroke and net downstroke reversal examples with maximum reversal forces which vary up to the approximate range of one gravity, any of which maximum reversal forces can be achieved by any of pumping units 5, 6, 7, or 8.

Charge 13 of FIG. 13 will first be described in connection with pumping unit 5, in which the gas in combination cavity means 186 and combination compression space 190, FIG. 5, exerts a combination force 376, FIG. 13, upon face 181 of combination piston 182 of pumping unit 5. The value of combination force 376 is just under 1.5 times RS+FC/2 at the bottom 378 of the stroke 377, and just under RS+FC/2 at the top 380 of the stroke 377. Dashed reference line 382 indicates the positive value of one times RS+FC/2.

The gas in upstroke reversal cavity 174 and upstroke reversal compression space 180 applies an upstroke reversal force 384, chart 13, against face 171 of upstroke reversal piston 170. This force 384 is downwardly directed and is shown on chart 13 as a negative force, the greatest value of which is in the range of 0.3 RS+FC/2, at the top 380 of the stroke 377.

The actual weight of the rod string plus one-half the weight of the fluid column (RS+FC/2), which is a constant negative force throughout the stroke cycle, is shown at 386.

The positive combination force 376 is added to the negative upstroke reversal force 384 and the negative weight 386 to determine the downwardly directed net upstroke reversal force (N.U.R.F.) 388, and the upwardly directed net downstroke reversal force (N.D.R.F.) 390.

Figure 5:
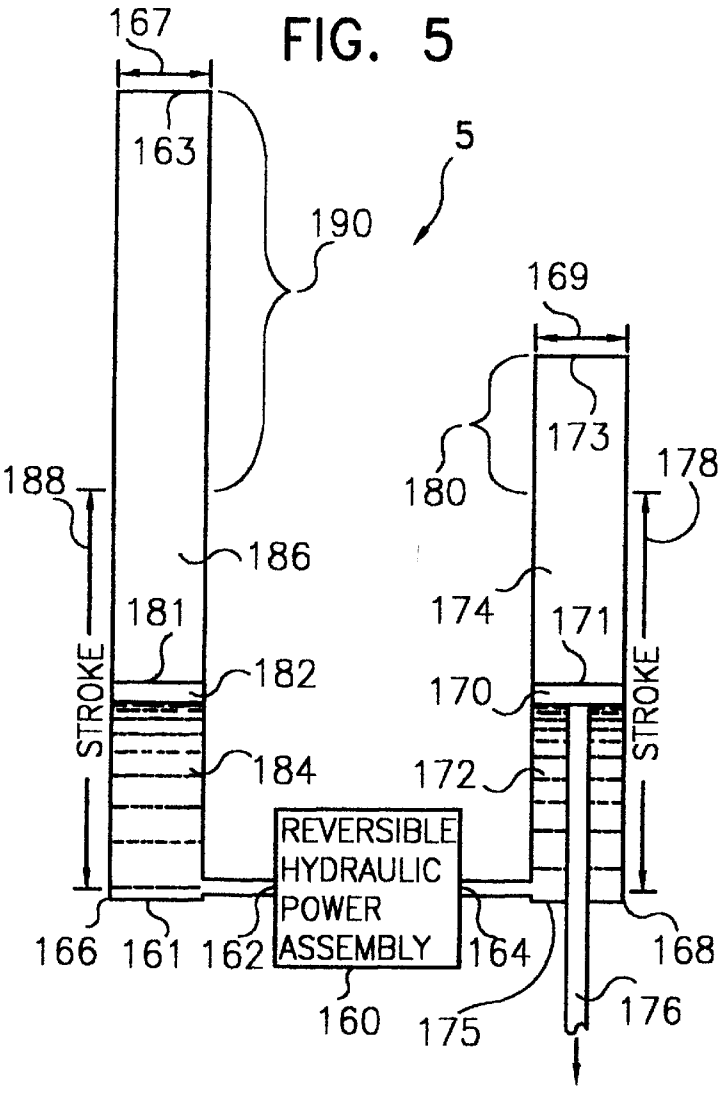
FIG. 5 is a schematic drawing of pumping unit 5, in which the hydraulic drive utilizes one cavity in each of two cylinders, the first one of which has an extended second cavity which comprises the upstroke reversal compression space, the second cylinder having an extended second cavity which comprises a combination counterbalance and downstroke reversal compression space.

The N.U.R.F. 388, in the top portion of stroke 377, and the N.D.R.F. 390, in the lower portion of the stroke 377, represent the sum of all forces upon piston 170 of FIG. 5, except for the force furnished by reciprocating hydraulic power assembly 160 of FIG. 5. The upward force furnished by component 160 upon piston 170 is hydraulic and direct, while the downward force upon piston 170 is achieved by upward hydraulic force upon piston 182, which partly offsets, and reduces, the downward gas pressure force upon face 181 of piston 182, which translates to a downward force upon piston 170 by lowering the upward force upon its lower face.

The various designed reversal characteristics of pumping units 5, 6, 7, and 8, which are demonstrated in charts 13, 14, and 15, all display the N.U.R.F. 388 and the N.D.R.F. 390, of chart 13, as equal in maximum values 389 and 391, respectively, and with their common zero point 393 in the center 395 of the stroke 377.

The selected reversal characteristics of the subject system are not necessarily symmetrical as demonstrated, but unequal maximum values 389 and 391, and a different location for the common zero point 393, can be selected over a wide range for various applications which require an imbalance between the upstroke and the downstroke reversal forces.

The controlling factors of the respective reversal forces are, in combination, the volume of the upstroke reversal compression space 180 of FIG. 5, the volume of the combination compression space 190, the amount of gas in upstroke reversal compression space 180 and upstroke reversal cavity 174, and the amount of gas in combination compression space 190 and combination cavity 186. The major controlling factor in determination of maximum reversal forces is the volume of the combination compression space, 190 in FIG. 5.

Referring to chart 13 and pumping unit 5 together, the cylinders 166 and 168 are shown with equal diameters 167 and 169, respectively, and their strokes 178 and 188 are equal. Strokes 178 and 188 correspond somewhat to stroke 377 of FIG. 13, chart 13, although the relative dimensions of the drawing for pumping unit 5 do not produce the exact characteristics which are shown in chart 13.

The size of the upstroke reversal compression space 180 is therefore illustrated on chart 13 as 25% of the size of piston swept volume 178 of cylinder 168.

The location of piston 170 at end 175 of cylinder 168 compares to the bottom 378 of stroke 377, FIG. 13, and end 173 of cylinder 168 is 15 units beyond the top 390 of stroke 377 to the left, on chart 13; indicated at arrow 381. Stroke 377 is in demonstrated as 60 units, the upstroke reversal compression space 180, which has the same cross section, is 15 units long, and from end 173 to end 175 of cylinder 168 is 75 units, the marker for which is aligned with the bottom 378 of stroke 377, FIG. 13.

The location of piston 182 at end 161 of cylinder 166, FIG. 5, compares to the top 380 of stroke 377, FIG. 13, and stroke 188 compares to stroke 377. in the examples of FIG. 13, end 163 of cylinder 166 is 120 units off chart 13, to the right side indicated at arrow 383, and the total length of cylinder 166 is illustrated on chart 13 as 180 units.

The size of the combination compression space 190 is illustrated on chart 13 as twice the size of the piston swept volume, stroke 188 of FIG. 5. This size relationship yields a maximum 389 N.U.R.F. 388 and a maximum 391 N.D.R.F. 390 of approximately one-third the sum of the rod string weight plus one-half the fluid column weight, or ⅓[RS+FC/2].

Chart 14 of FIG. 14 is another example of reversal characteristics which can be produced by variation of the relative sizes of, and gas pressures within, the upstroke reversal compression space and the combination compression space of any of pumping units 5, 6, 7, or 8.

The weight of RS+FC/2 is shown at 400, the upstroke reversal force at 402, the combination force at 404, and the positive value RS+FC/2 reference line at 406.

Upstroke reversal force 402 has a minimum negative value 408 at the bottom 410 of stroke 412, and a maximum negative value 416 at the top 414 of stroke 412. The upstroke reversal compression space 418 is a space of 16 units off the chart to the left, and is 26% of the stroke 412 space, which is 60 units.

Combination force 404 has a maximum positive value 420 at the bottom 410 of stroke 412 of approximately 1.6[RS+FC/2], and a minimum positive value 422 at the top 414 of stroke 412 of approximately 0.9[RS+FC/2]. The combination compression space is indicated at arrow 424, and comprises a space of 80 units, off chart 14 to the right.

The combination compression space 424, at its volume of 80 units, is 1.33 times the volume of the piston swept stroke 412 volume of 60 units, and this size relationship produces a N.U.R.F. 426 and a N.D.R.F. 428 which have respective maximum values 430 and 432 of approximately 0.5[RS+RS/2].

N.U.R.F. 426 and N.D.R.F. 428 are the respective negative and positive portions of the sum of the weight 400 of RS+FC/2, the upstroke reversal force 402, and combination force 404.

Chart 15 of FIG. 15 is similar to charts 13 and 14. The negative RS+FC/2 force, the weight of the rod string plus one-half the fluid column weight, is shown at 434, the negative upstroke reversal force at 436, and the positive combination force at 438.

The sum of these forces equals the negative N.U.R.F. 440 and the positive N.D.R.F. 442, respectively. The upstroke reversal compression space is 10 units, off the chart to the left, indicated at arrow 450. The stroke 444 covers 60 units on chart 15, so the upstroke reversal compression space volume 450 is 16.7% of the volume of the piston swept space in stroke 444.

The combination force 438 has a maximum positive value of 2[RS+FC/2] at the bottom 448 of stroke 444, and a minimum value of approximately 0.8[RS+FC/2] at the top 446 of stroke 444. The combination compression space comprises 40 units, off chart 15 to the right, and is indicated at arrow 452. Stroke 444 covers 60 units on chart 15, and the combination compression space 452, at 40 units, is 66.6% of the piston swept volume (stroke 444).

The ratio of the two volumes, above, of 60 units and 40 units, respectively, produces the N.U.R.F. 440 and N.D.R.F. 442 as shown on the chart, with respective maximum values 452 and 454 of approximately 0.9[RS+FC/2].

Charts 13, 14, and 15 indicate methods for providing progressive net upstroke reversal forces and progressive net downstroke reversal forces with various maximum strengths, and these charts apply equally to pumping units 5, 6, 7, and 8.

The relationship between the charts and the pumping units is easily observed by a comparison of one of the charts to pumping unit 8 of FIG. 8.

In chart 15 the stroke 444 compares to stroke 270 of pumping unit 8. The combination compression space 278, of FIG. 8, is connected to end 259 of cylinder 258, and the combination compression space 452 of FIG. 15 is indicated adjacent the area of stroke 444, off of chart 15 to the right, at arrow 452, and combination compression space 452 has a volume of 40 units, compared to a volume of 60 units for the piston swept stroke 444.

The upstroke reversal compression space 276, of FIG. 8, is connected to the other end 261 of cylinder 258, and the upstroke reversal compression space 450, of FIG. 15, is indicated adjacent stroke area 444, of chart 15 to the left, at arrow 450, and has a volume of 10 units, compared to the piston swept volume of stroke 444 of 60 units.

FIG. 16 is chart 16 which plots the volume of the combination compression space 460 as a multiple of the maximum piston swept volume of the combination cavity means 462 horizontally, against the maximum net reversal force 464 vertically.

The combination cavity means maximum volume 462 is charted as 1.0 units, indicated at 466, and maximum net reversal forces 464 are compared to the weight of the rod string plus one-half the weight of the fluid column (RS+FC/2), which is indicated at 468 as one unit.

The curve 470 of chart 16 is the result of plotting of the following coordinates: point 472, volume ratio 5 to 1 and maximum net reversal force 0.14 (RS+FC/2); point 474, ratio 3.3 to 1 and maximum force 0.2 (RS+FC/2); point 476, ratio 2.0 to 1 and maximum force 0.3 (RS+FC/2); point 478, ratio 1.33 to 1 and maximum force 0.5 (RS+FC/2); and point 480, ratio 0.67 to 1 and maximum force 0.9 (RS+FC/2).

While these forces for a particular ratio may vary slightly because of the influence of and possible variation in the selected size of the accompanying upstroke reversal compression space, the plotting of the points 472, 474, 476, 478, and 480 at least approximately defines a curve 470 in which the product of multiplication of the two coordinates for any point along the curve equals a constant.

Point 472 coordinates of 5.0 times 0.14 equals 0.70; point 474, 3.3 times 0.2 equals 0.66; point 476, 2.0 times 0.30= 0.60; point 478, 1.33 times 0.5 equals 0.66; point 480, 0.67 times 0.90 equals 0.60.

Although several embodiments of the pumping unit of the present invention have been described, those skilled in the art will recognize that various substitutions, modifications, and rearrangements may be made to these embodiments without departing from the scope and spirit of this invention as recited in the appended claims.

I claim:

1. A pumping unit, mounted at least approximately at surface elevation, which supports and vertically reciprocates a rod string and downhole pump, said pumping unit comprising reciprocally applied linear drive means, and counterbalance means which applies an upwardly directed counterbalance force to said rod string throughout the stroke cycle of said pumping unit, the improvement in combination therewith comprising a dynamic upstroke reversal and downstroke reversal system, said system comprising:

downward force means which comprises:

cylindrical downward force cavity means;

downward force piston surface means within said downward force cavity means, said downward force piston surface means at least indirectly connected to, and arranged to move reciprocally with, said rod string;

a selected volume of enclosed downward force compression space in communication with said downward force cavity means;

a selected amount of compressed downward force gas contained within said downward force cavity means and said downward force compression space, the flow of said downward force gas between said cavity means and said compression space unimpeded;

said downward force gas exerting a downward force upon said downward force piston surface means, said downward force transferred to said rod string in a downward direction, throughout said stroke cycle of said pumping unit, said downward force varying in value from a maximum at the top of the stroke, to a minimum at the bottom of said stroke;

upward force means which comprises:

cylindrical upward force cavity means;

upward force piston surface means within said upward force cavity means, said upward force piston surface means at least indirectly connected to, and arranged to move reciprocally with, said rod string;

a selected volume of enclosed upward force compression space in communication with said upward force cavity means;

a selected amount of compressed upward force gas contained within said upward force cavity means and said upward force compression space, the flow of said upward force gas between said cavity means and said compression space unimpeded, said upward force gas exerting an upward force upon said upward force piston surface means, said upward force transferred to said rod string in an upward direction, throughout said stroke cycle of said pumping unit, said upward force varying in value from a maximum at said bottom of said stroke, to a minimum at said top of said stroke;

the sum of said upward force and said downward force having a value of zero at a common point within the central portion of said upstroke and said downstroke, respectively, said sum of said upward force and said downward force further comprising a downwardly directed upstroke reversal force which increases from said zero value at said common point, to its maximum value at said top of said stroke, and, respectively, an upwardly directed downstroke reversal force which increases from said zero value at said common point, to its maximum value at said bottom of said stroke.

2. The pumping unit of claim 1, in which said upward force piston surface means comprises free piston means.

3. The pumping unit of claim 1, in which said reversible linear drive means comprises mechanical drive means.

4. The pumping unit of claim 1, in which said counterbalance means comprises mechanical counterweight means.

5. The pumping unit of claim 1, in which said drive means is active throughout a large central portion of the upstroke and of the downstroke, respectively, of said pumping unit, and is passive for two smaller portions of said stroke cycle which, respectively, begin before and end after said top of said stroke, and begin before and end after said bottom of said stroke.

6. The pumping unit of claim 1, in which a common cylinder means comprises said upward force cavity means, said upward force compression space, said downward force cavity means, and said downward force compression space; a common piston means comprises said upward force piston surface means and said downward force piston surface means.

7. The pumping unit of claim 1, in which said drive means comprises hydraulic drive cylinder means, and said counterbalance means comprises pneumatic counterbalance means which comprises:

cylindrical counterbalance cavity means;

counterbalance piston surface means within said counterbalance cavity means, said counterbalance piston surface means at least indirectly connected to, and arranged to move reciprocally with, said rod string, said counterbalance piston surface means reciprocally sweeping said counterbalance cavity means during each said stroke cycle of said pumping unit;

a selected volume of enclosed counterbalance compression space in communication with said counterbalance cavity means;

a selected amount of compressed gas contained within said counterbalance cavity means and said counterbalance compression space, the flow of said gas between said counterbalance cavity means and said counterbalance compression space at least almost unimpeded;

said gas exerting a counterbalance force upon said counterbalance piston means, said counterbalance force transferred to said rod string in an upward direction, throughout said stroke cycle of said pumping unit, said force varying in value from a maximum at said bottom of said stroke, to a minimum at said top of said stroke.

8. The pumping unit of claim 7, in which said variation of said counterbalance force from said bottom to said top of said stroke is at least approximately compensated for by selective adjustment of at least one of:

said selected volume of said enclosed upward force compression space;

said selected amount of compressed gas contained within said upward force cavity means and said upward force compression space;

said selected volume of said enclosed downward force compression space;

said selected amount of compressed gas contained within said downward force cavity means and said down force compression space;

said adjustment causing a sum of said upward force, said downward force, and said variation in said counterbalance force to have a value of zero at a second common point within said central portion of said stroke.

9. The pumping unit of claim 8, in which said selective adjustment is such that said second common point is located at least approximately at the center of said respective upstroke and downstroke, and respective said maximum values for said respective reversal forces are at least approximately equal.

10. The pumping unit of claim 7, in which said selective adjustment to compensate for said variation of said counterbalance force, comprises an increase in said selected volume of said upward force compression space.

11. The pumping unit of claim 7, in which said selective adjustment to compensate for said variation of said counterbalance force, comprises a decrease in said selected amount of compressed gas contained within said upward force cavity means and said upward force compression space.

12. The pumping unit of claim 8, in which at least one of said upward force compression space, said downward force compression space, and said counterbalance compression space, comprises independent pressure vessel means.

13. The pumping unit of claim 1, in which said hydraulic drive cylinder means is arranged co-axially with said rod string, its output shaft mechanically connected to said rod string.

14. The pumping unit of claim 1, in which said counterbalance means comprises first pneumatic cylinder means, said upward and said downward force means together comprise single pneumatic cylinder means;

said hydraulic drive cylinder means, and at least one of said first pneumatic cylinder means and said single pneumatic cylinder means, having common shaft means arranged co-axially with, and mechanically connected to, said rod string.

15. The pumping unit of claim 1, in which said compressed gas comprises nitrogen gas.

16. The pumping unit of claim 7, in which said reversible linear drive means comprises reciprocating hydraulic drive cylinder means in combination with fixed displacement hydraulic pump means.

17. The pumping unit of claim 7, in which said reversible linear drive means comprises reciprocating hydraulic drive cylinder means in combination with variable displacement hydraulic pump means.

18. The pumping unit of claim 1, in which said counterbalance means is a pneumatic counterbalance means, which is combined with said downstroke reversal means in a single combination force means which comprises;

said cylindrical upward force cavity means and said upward force piston surface means;

a selected volume of enclosed counterbalance compression space in communication with said upward force cavity means and said upward force compression space;

a selected amount of compressed gas contained within said upward force cavity means, said upward force compression space and said counterbalance compression space, the flow of said gas between said upward force cavity means, said upward force compression space and said counterbalance space at least almost unimpeded;

said gas exerting a combination force upon said upward force piston surface means, said force transferred to said rod string in an upward direction, throughout said stroke cycle of said pumping unit, said combination force varying in value from a maximum at said bottom of said stroke, to a minimum at said top of said stroke.

19. The pumping unit of claim 18, wherein said combination force includes said upward force and a counterbalance force; wherein said counterbalance force varies in value from a maximum at said bottom of said stroke to a minimum at said top of said stroke; and wherein said variation of said counterbalance force is compensated for by selective adjustment of at least one of:

said volume of said upward force compression space;

said amount of compressed gas within said upward force cavity means and said upward force compression space;

said volume of said downward force compression space;

and said amount of compressed gas within said downward force cavity means and said downward force compression space;

wherein a sum of said upward force, said downward force, and said variation in said counterbalance force has a value of zero at a second common point within said central portion of said stroke.

20. The pumping unit of claim 19, in which said second common point at least approximately in the center of said upstroke and said downstroke, respectively.

21. The pumping unit of claim 19, in which said maximum value for said upward force and said variation in said counterbalance force is approximately equal to said maximum value for said downward force.

22. The pumping unit of claim 19, in which said volume of said downward force compression space is less than 30% of the maximum volume of said downward force cavity means.

23. The pumping unit of claim 19, in which said volume of said upward force compression space and said counterbalance compression space is no larger than triple the maximum volume of said upward force cavity means.

24. The pumping unit of claim 19, in which said maximum value of said upward force and said downward force, respectively, increases as the ratio of said volume of said upward force compression space and said counterbalance compression space decreases in respect to the maximum volume of said upward force cavity means.

25. The pumping unit of claim 24, in which variations of said ratio in respect to matching and at least approximately equal values for said respective maximum upward and downward forces, form a graphic curve, in which:

said volume of said upward force compression space and said counterbalance compression space is expressed as a multiple of said maximum volume of said upward force cavity means;

said maximum upward and downward forces are expressed as a fraction of: the weight of said rod string (RS) plus one half a weight of a fluid column (FC) of a well;

said curve including the following points:

ratio 5 to 1 and force 0.14[RS+FC/2], ratio 3.25 to 1 and force 0.2[RS+FC/2], ratio 2 to 1 and force 0.30[RS+FC/2], ratio 1.33 to 1 and force 0.5[RS+FC/2], ratio 0.67 to 1 and force 0.9[RS+FC/2].

26. The pumping unit of claim 24, in which variations of said ratio in respect to matching and at least approximately equal values for said respective maximum upward and downward forces, form a graphic curve, in which:

said volume of said upward force compression space and said counterbalance compression space is expressed as a multiple of said maximum volume of said upward force cavity means;

said maximum upward and downward forces are expressed as a fraction of: the weight of said rod string plus one half a weight of a fluid column of a well;

multiplication of the value of the two coordinates for respective points along said graphic curve is at least approximately equal to a constant product.

27. The pumping unit of claim 19, in which said maximum value for said upward force and said variation in said counterbalance force differs from said maximum value for said downward force, by a selected amount.

28. The pumping unit of claim 18, in which at least one of said downward force compression space and a combination space compression space including said upward force compression space and said counterbalance compression space comprises independent pressure vessel means.

29. The pumping unit of claim 18, in which a single cylinder means having single piston means comprises said single combination force means and said downward force means.

30. The pumping unit of claim 28, in which:

first cylinder means, having first and second ends, comprises said upward force cavity means, a combination space compression space including said upward force compression space and said counterbalance compression space comprises independent pressure vessel means connected to said first end of said first cylinder means;

second cylinder means which comprises said downward force cavity means;

said upward force cavity means having a maximum volume equal to the maximum volume of said downward force cavity means, and having a length which is substantially less than the length of said downward force cavity means;

said upward force piston surface means comprises free piston means;

control shaft means attached at the center of, and perpendicular to the surface of, said free piston means, and extending toward said first end of said first cylinder means;

said control shaft means having a length at least slightly greater than the maximum length of said upward force cavity means, and supporting at its free end actuator means;

a small diameter extension of said first cylinder means at the center of its said first end, with a length and an inside diameter sufficient to receive said control shaft means;

multiple switch means at respective selected locations along the inside of said length of said extension, arranged for individual successive activation by said actuator means during said stroke cycle of said pumping unit.

31. A pumping unit, mounted at least approximately at surface elevation, which supports and vertically reciprocates a rod string and downhole pump, the improvement in combination therewith comprising a dynamic upstroke reversal and downstroke reversal system in combination with pneumatic counterbalance means, and in which the cyclic operation of said system is automatic and the maximum value of said respective reversal forces is individually selectable, said pumping unit comprising first cylinder means, second cylinder means, and reversible hydraulic drive means, in which:

said first cylinder means is vertically aligned and comprises:

first piston means separating said first cylinder means into respective piston swept upper and lower cavity means;

shaft means attached to said first piston means and extending downwardly to at least indirectly connect to said rod string;

first hydraulic port means located at least near the lower end of said first cylinder means to alternately receive and expel hydraulic fluid;

an extension of said first cylinder means beyond said piston swept upper cavity means, said extension comprising a first compression space with a selected volume;

a first selected amount of compressed gas contained by said upper cavity means and said first compression space;

said second cylinder means comprising free piston means separating said second cylinder means into piston swept first and second cavity means, said respective cavity means open to first and second ends, respectively, of said second cylinder means;

second hydraulic port means located at least near said first end of said second cylinder means, and arranged to alternately receive and expel hydraulic fluid;

an extension of said second cylinder means beyond said piston swept second cavity means, said extension comprising a second compression space with a selected volume;

a second selected amount of compressed gas contained by said second cavity means and said second compression space;

said reversible hydraulic drive means comprising two drive port means, each of which functions, respectively and in turn, as an outlet drive port and as an inlet drive port, said drive port means connected, respectively, to said first hydraulic port means and said second hydraulic port means;

said first selected amount of compressed gas exerting a downwardly directed upstroke reversal force upon said first piston means and said rod string throughout the stroke cycle of said pumping unit, said upstroke reversal force varying throughout said stroke cycle and having its said maximum value at the top of said stroke;

said second selected amount of compressed gas exerting a combination force, upon said free piston means, said force transferred indirectly to said first piston means and said rod string in an upward direction, throughout said stroke cycle of said pumping unit;

wherein said combination force is equal to an upwardly directed downstroke reversal force plus a counterbalance force;

said counterbalance force having an at least approximately constant value throughout said stroke cycle;

said downstroke reversal force varying throughout said stroke cycle and having its said maximum value at the bottom of said stroke;

the sum of said upstroke reversal and said downstroke reversal forces having a value of zero at a common point within the central portion of said upstroke and downstroke, respectively;

said maximum values of said net upstroke reversal force and said downstroke reversal force, respectively, and the location of said common point, determined by proper selections, in combination, of: said volume of said first compression space, said first amount of compressed gas, said volume of said second compression space, and said second amount of compressed gas;

said respective maximum values for said net reversal forces increasing as alternate said selections are substituted in which the changes in the initial said selections include a decrease in said selected volume of said second compression space.

32. A pumping unit, mounted at least approximately at surface elevation, which supports and vertically reciprocates a rod string and downhole pump, the improvement in combination therewith comprising a dynamic upstroke reversal and downstroke reversal system in combination with pneumatic counterbalance means, in which the cyclic operation of said system is automatic and the maximum value of said respective reversal forces is individually selectable; said pumping unit comprising first cylinder means, second cylinder means, reversible hydraulic drive means, first pressure vessel, and second pressure vessel, in which:

said first cylinder means and said second cylinder means are mounted vertically and in axial alignment;

said first cylinder means comprises first piston means which divides said first cylinder means into upper cavity means and lower cavity means, respectively;

said second cylinder means comprises hydraulic power cylinder means having second piston means, and having respective power port means located at least near its upper end and at least near its lower end, respectively, said reversible hydraulic drive means comprising first and second drive port means, each of which functions, respectively and in turn, as an outlet drive port and as an inlet drive port, said first and second drive port means connected, respectively, to said first power port means and said second power port means;

said first piston means and said second piston means attached to common shaft means which is at least indirectly connected to said rod string;

said first pressure vessel having a selected volume and operably joined to said first cylinder means at least near the upper end of said upper cavity means;

a first selected amount of compressed gas contained by said upper cavity means and said first pressure vessel;

said second pressure vessel having a selected volume and operably joined to said first cylinder means at least near the lower end of said lower cavity means;

a second selected amount of compressed gas contained by said lower cavity means and said second pressure vessel;

said first selected amount of compressed gas exerting a downwardly directed upstroke reversal force upon said first piston means and said rod string throughout the stroke cycle of said pumping unit, said upstroke reversal force varying throughout said stroke cycle and having its said maximum value at the top of said stroke;

said second selected amount of compressed gas exerting a combination force, upon said first piston means and said rod string throughout said stroke cycle of said pumping unit, wherein said combination force is equal to an upwardly directed downstroke reversal force plus a counterbalance force;

said counterbalance force having an at least approximately constant value throughout said stroke cycle;

said downstroke reversal force varying throughout said stroke cycle and having its said maximum value at the bottom of said stroke;

the sum of said upstroke reversal and said downstroke reversal forces having a value of zero at a common point within the central portion of said upstroke and downstroke, respectively;

said maximum values of said upstroke reversal force and said downstroke reversal force, respectively, and the location of said common point, determined by proper selections, in combination, of: said volume of said first pressure vessel, said first amount of compressed gas, said volume of said second pressure vessel, and said second amount of compressed gas;

said respective maximum values for said reversal forces increasing as alternate said selections are substituted in which the changes in the initial said selections include a decrease in said selected volume of said second pressure vessel.

* * * * *